US010344433B2

(12) United States Patent
Maki

(10) Patent No.: US 10,344,433 B2
(45) Date of Patent: Jul. 9, 2019

(54) SUBGRADE PEAT STABILISATION SYSTEM FOR RAILWAY

(71) Applicant: TBT Engineering Limited, Thunder Bay (CA)

(72) Inventor: Gordon C. Maki, Thunder Bay (CA)

(73) Assignee: TBT Engineering Limited, Thunder Bay (CA)

( * ) Notice: Subject to any disclaimer, the term of this patent is extended or adjusted under 35 U.S.C. 154(b) by 253 days.

(21) Appl. No.: 15/427,311

(22) Filed: Feb. 8, 2017

(65) Prior Publication Data

US 2017/0284031 A1 Oct. 5, 2017

Related U.S. Application Data

(60) Provisional application No. 62/315,763, filed on Mar. 31, 2016.

(51) Int. Cl.

| | |
|---|---|
| ***E01B 1/00*** | (2006.01) |
| ***E01B 27/02*** | (2006.01) |
| ***E02D 3/10*** | (2006.01) |

(52) U.S. Cl.
CPC ..... *E01B 1/008* (2013.01); *E01B 27/02* (2013.01); *E02D 3/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,713,420 A * | 5/1929 | Chmura | E01B 1/008 238/1 |
| 3,038,396 A * | 6/1962 | Jameson, Jr. | E02D 3/10 138/114 |
| 3,928,979 A * | 12/1975 | Terashima | E02B 11/00 405/50 |
| 2010/0178111 A1* | 7/2010 | Samara | E02B 11/005 405/43 |

FOREIGN PATENT DOCUMENTS

| | | | |
|---|---|---|---|
| CA | 2848527 | 2/2013 | |
| DE | 2620696 A1 * | 11/1977 | E02D 3/106 |

* cited by examiner

*Primary Examiner* — Kyle Armstrong
(74) *Attorney, Agent, or Firm* — Ryan W. Dupuis; Ade & Company Inc.; Kyle R. Satterthwaite

(57) ABSTRACT

A ground stabilisation system is used for stabilising a subgrade region which includes a peat layer under a railway having rails supported across rail ties on a ballast layer over the subgrade region. The system uses a plurality of drain members submerged in an upright orientation within the peat layer of the subgrade region in which each drain member has a hollow interior and a plurality of openings therein which allow communication of fluid from the peat layer surrounding the drain member into the hollow interior of the drain member so as to be arranged to reduce fluid pressure in the peat layer when the peat layer undergoes dynamic loading from a passing train. Each drain member is a semi-rigid pipe having an axial stiffness greater than a dynamic stiffness of the peat layer to reduce loading on the peat layer under dynamic loading from a passing train.

16 Claims, 7 Drawing Sheets

SUBGRADE PEAT STABILISATION SYSTEM FOR RAILWAY

This application claims the benefit under 35 U.S.C. 119(e) of U.S. provisional application Ser. No. 62/315,763, filed Mar. 31, 2016.

FIELD OF THE INVENTION

The present invention relates to a system and method for stabilising ground below a railway that includes a subgrade peat layer, and more particularly the present invention relates to a ground stabilisation system for including a plurality of permeable drain members submerged within the peat layer so as to be arranged to receive fluid from the peat layer within a hollow interior of the drain members for reducing fluid pressure in the peat layer when the peat layer undergoes dynamic loading from a passing train.

BACKGROUND

A common problem for railway embankments constructed over a peat subgrade is the formation of "peat boils" and/or migration of the peat subgrade soil through the railway embankment. Due to increased train loads and more frequent train traffic over recent years, zones of peat below the embankment are experiencing liquefaction under loading from moving trains. Once liquefied, the zone of peat cannot support the above fill and the fill is allowed to collapse into the peat subgrade creating a hole or channel to form through the overlying embankment fills. Upon further train loading, liquefied peat can eject to the embankment surface through the open channel commonly referred to as a peat boil. In some cases, no hole or channel is formed, however the weakened peat flows or seeps through the embankment fills to the embankment surface (peat migration). The loss of peat below the embankment leads to differential settlements of the tracks. Zones of liquefied peat are also of low strength and pose a risk to embankment stability.

Typical treatments currently in use involve full excavation of the peat subgrade and replacement will suitable fill, or the placement of confining barrier (reinforcing grid/geotextile) between the peat and fills (to restrict movement of the peat into the embankment). While full excavation of the peat will fully eliminate the risk of further peat boils or migration, significant costs are associated with construction and train delays.

The second option consisting of peat containment can mitigate the transport of liquefied peat. However, zones of peat will likely still liquefy leading to increased risks for embankment instability. This is also considered a high cost option given the track time (delays for trains) required to take the track out of service for construction.

Canadian Patent Application No. 2,848,527 by Aspin Foundations Limited describes a railway track support system comprising insertion of an elongate support, such as a pile, having a generally hollow interior into the ground in the vicinity of existing railway track in-situ. The support is inserted to a depth such that the entire support is below the surface of the ground thereby leaving a void between the support and the surface of the ground. A cementitious material is inserted into the hollow interior of the support. Ballast material is subsequently inserted into the void between the support and the ground surface. Supports may be inserted between existing sleepers and/or rails and may be overfilled with the cementitious material such that a portion of the material forms a cementitious cap. The filling of each hollow support with cementitious material results in a non-permeable, rigid pile which functions only to take load away from the peat layer which is not well suited to the dynamic loading of passing trains, and which does not address the build up of fluid pressure in the peat.

SUMMARY OF THE INVENTION

The new system described here was developed to reduce the risk and extent of peat becoming liquefied, thus mitigating peat boils and/or migration and the increased risk of embankment instability. The system was also developed to address the need to limit train traffic disruption during installation.

According to one aspect of the invention there is provided a ground stabilisation system for a railway having rails supported across rail ties on a ballast layer over a subgrade region which includes a peat layer, the system comprising:

a plurality of drain members submerged in an upright orientation within the peat layer of the subgrade region;

each drain member including a hollow interior and a plurality of openings therein which allow communication of fluid from the peat layer surrounding the drain member into the hollow interior of the drain member so as to be arranged to reduce fluid pressure in the peat layer when the peat layer undergoes dynamic loading from a passing train.

According to a second aspect of the present invention, there is provided a method of stabilising a railway having rails supported across rail ties on a ballast layer over a subgrade region which includes a peat layer, the method comprising:

providing a plurality of elongate drain members each including a hollow interior and a plurality of openings therein;

submerging the drain members in an upright orientation within the peat layer of the subgrade region such that fluid can readily pass through the openings in the drain members from the peat layer surrounding the drain member into the hollow interior of the drain members.

The main objective of the drain members (also referred to herein as spring drains) is to reduce excess porewater pressure within the peat subgrade during the passing of a train which will reduce the risk of the peat becoming liquefied. During the passing of a train, the train load is transferred from the wheels to the rails and then to the ties. From the ties, the load is transferred to the ballast, embankment fills and underlying peat subgrade. Once the compressive load is taken by the peat subgrade, the load is shared by both the peat soil matrix and the porewater water between the soil particles. As water is effectively incompressible, excess porewater pressures develop. When the peat soil matrix compresses under loading, the porewater pressures will increase further.

As water flows out of the peat stratum, the porewater pressure will reduce. However, the rate of water flow through the peat stratum is limited by the permeability of the compressed peat and the length of the drainage path through the peat stratum (typically the 0.5 to 1 times the peat thickness, depending of the permeability of the soils above and below the peat). As the ability of the peat stratum to shed excess porewater is limited, porewater pressures within the peat tend to increase with repeated loading (as the train wheels pass). When the rate of porewater pressure increase is greater than the ability of the peat to shed excesses porewater pressures, the porewater pressures can increase until a critical level is reached. Once the porewater pressure is equal to, or exceeds the weight above a point within the peat subgrade, liquefaction of the peat occurs (effective stress within the peat is equal to or less than zero). Once a zone of peat has liquefied, it is expected that the zone will become larger with repeated loading. This has become more critical with more frequent, longer and heavier trains.

In addition to excess porewater pressure from the compressive stresses generated by the train traffic, additional excess porewater pressure within the peat may also be attributed to shear stress/strain within the peat subgrade. Where the embankment configuration has a low shear stiffness (through the peat subgrade) and undergoes shear deformations, additional excess porewater pressures occur along zones of high shear stress/strain within the peat soils.

Another possible contributing factor to increased porewater pressure within the peat is the "wave" effect (however, this phenomenon has not been confirmed at this time). The theory behind the "wave" effect is that excess porewater pressure within the peat subgrade is initiated by the wheel loading of a moving train and that excess porewater pressure will travel in the direction of wheel loading creating moving wave of excess porewater pressure. The waves can be compounded by repeated loading from subsequent wheel loads. Once the waves encounter a zone where the wave is restricted or constrained (e.g. at locations where the denser soils below the peat rise quickly, or where the peat soils transition to a denser soils over a short distance), additional excess porewater pressure may occur as the kinetic energy of the wave is suddenly terminated or reduced over a short distance.

The spring drains address excess porewater pressure generation within the peat subgrade using three techniques: improved drainage, reduced peat loading, and wave dissipation.

Preferably a top end of each drain member is spaced below an elevation of the rail ties such that i) the top end of each drain member terminates within a fill layer above the peat layer, and ii) ballast material spans between the top end of each drain member and an elevation of the rail ties.

Preferably a bottom end of each drain member terminates within a soil layer below the peat layer such that each drain member spans a full height of the peat layer.

Preferably each drain member comprises a semi-rigid pipe, for example a perforated and corrugated plastic pipe. The semi-rigid pipe preferably has a stiffness in an axial direction which is greater than a dynamic stiffness of the peat layer so as to be arranged to reduce loading on the peat layer when the peat layer undergoes dynamic loading from a passing train.

Preferably the drain members are more permeable than the peat layer.

A horizontal spacing between adjacent drain members is preferably less than a length of a longest drainage path of peat in the peat layer to a nearest permeable boundary of the peat layer. The method may further include associating a plurality of drain members with each rail tie in a first region to be stabilized, and gradually reducing the number of drain members associated with each rail tie with increasing distance along the rails from the first region.

According to the preferred embodiment, the system preferably further comprises i) aggregate fill occupying the hollow interior thereof each drain member, ii) a filter material spanning over the openings in each drain member in the form of a sheet which fully surrounds each drain member and which has a smaller aperture size than a size of the openings, and iii) a reinforcing mesh fully surrounding each drain member.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
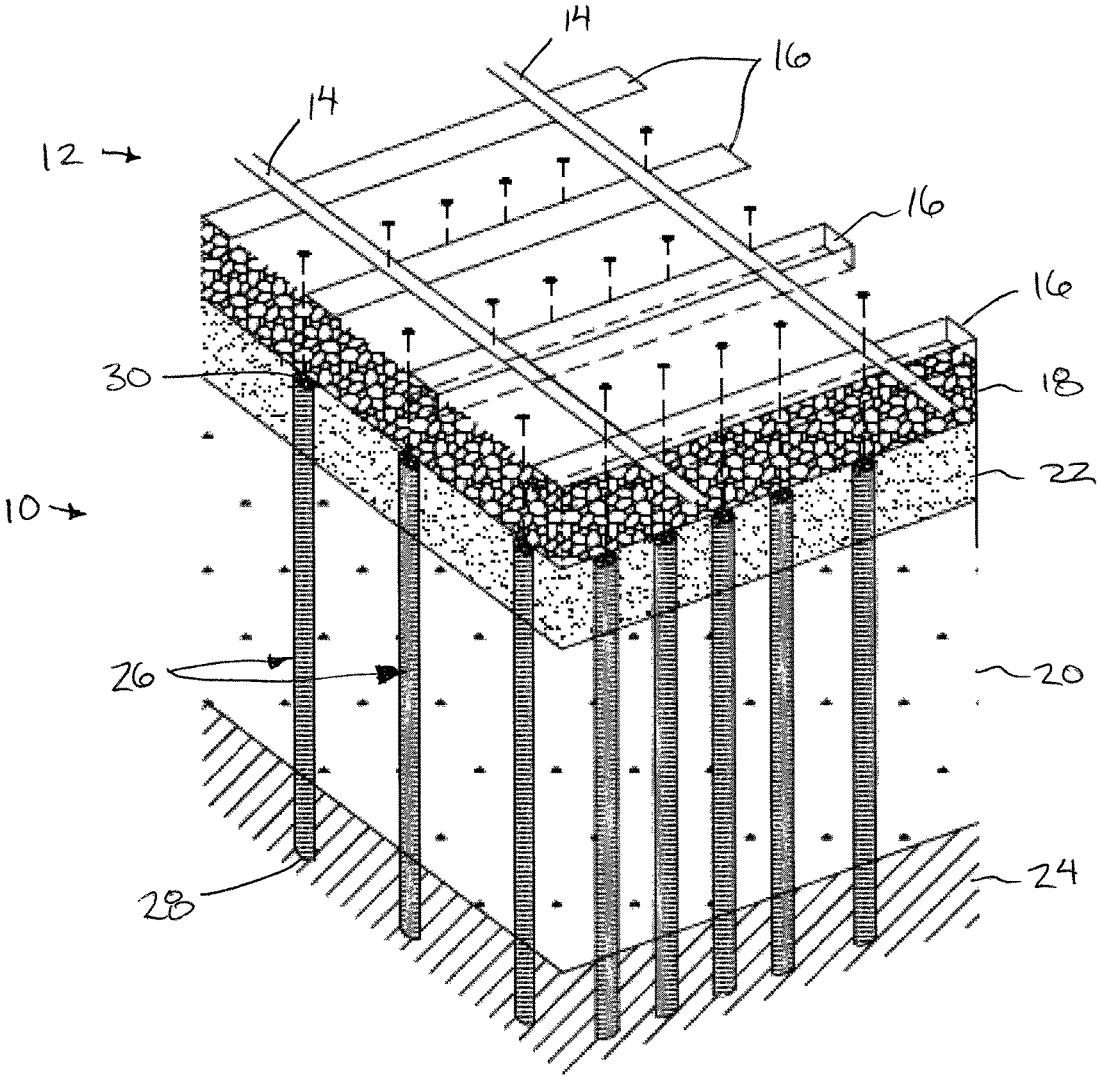
FIG. 1 is perspective view of the ground stabilisation system according to the present invention.

Referring to the accompanying figures there is illustrated a ground stabilization system generally indicated by reference numeral 10. The system 10 is particularly suited for use with a railway 12 extending over a region with subgrade peat.

The railway 12 typically comprises two rails 14 extending in a longitudinal direction of the railway across a plurality of rail ties 16. The rail ties 16 are parallel to one another and spaced apart in the longitudinal direction of the railway so as to be oriented perpendicularly to the rails. The rail ties 16 are set on a ballast layer 18 comprised of coarse aggregate.

In areas where the subgrade region has a peat layer 20, an upper layer of the peat may be excavated and a granular fill layer 22 is provided over top of the remaining peat layer upon which the more course ballast layer is laid. The peat layer typically has a lower boundary with an additional subgrade layer therebelow such as a soil layer 24.

The stabilisation system 10 includes a plurality of drain members 26 which are inserted or submerged into the subgrade region below the ballast layer underlying a railway. Each drain member comprises an elongate semi-rigid pipe formed of corrugated plastic material which is perforated with openings according to the illustrated embodiment. The pipe includes a hollow interior spanning the full height of the drain member between an open top end and a bottom end which is permanently or temporarily closed for insertion into the ground.

Each drain member 26 is typically installed in a vertical orientation to span the full height of the peat layer 20 such that i) the bottom end 28 is located within the soil layer 24 below the peat layer and ii) the top end 30 is located within the granular fill layer 22 which is both above the peat layer 20 and below the ballast layer 18. The top end of each drain member is thus spaced below the elevation of the rail ties by a height of the ballast layer. The diameter of each drain member is typically less than 0.3 m so as to be suitably sized for being inserted downwardly between an adjacent pair of spaced apart rail ties 16.

The pipe of each drain member is filled with an aggregate fill 32 which fully occupies the hollow interior of the drain member. The size of the particles of the aggregate is selected to ensure that the hollow interior of each drain member remains considerably more permeable than the surrounding peat layer.

A filter material 34 is provided as a sheet which is fully wrapped about the exterior of the pipe of each drain member such that the filter material spans over each of the openings of the perforated pipe. An aperture size of the filter material is considerably smaller than the size of the perforated openings in the pipe so that the filter material acts to better prevent migration of peat and soil surrounding the drain members into the hollow interiors of the drain members.

A reinforcing mesh 36 is wrapped about the pipe of each drain member at the exterior of the sheet of filter material to retain the filter material relative to the pipe and provide additional reinforcement to the drain member. The reinforcing mesh may be a plastic mesh or a woven fiber geotextile material for example, so as to provide tensile reinforcement axially along each drain member and/or circumferentially about each drain member.

Figure 2:
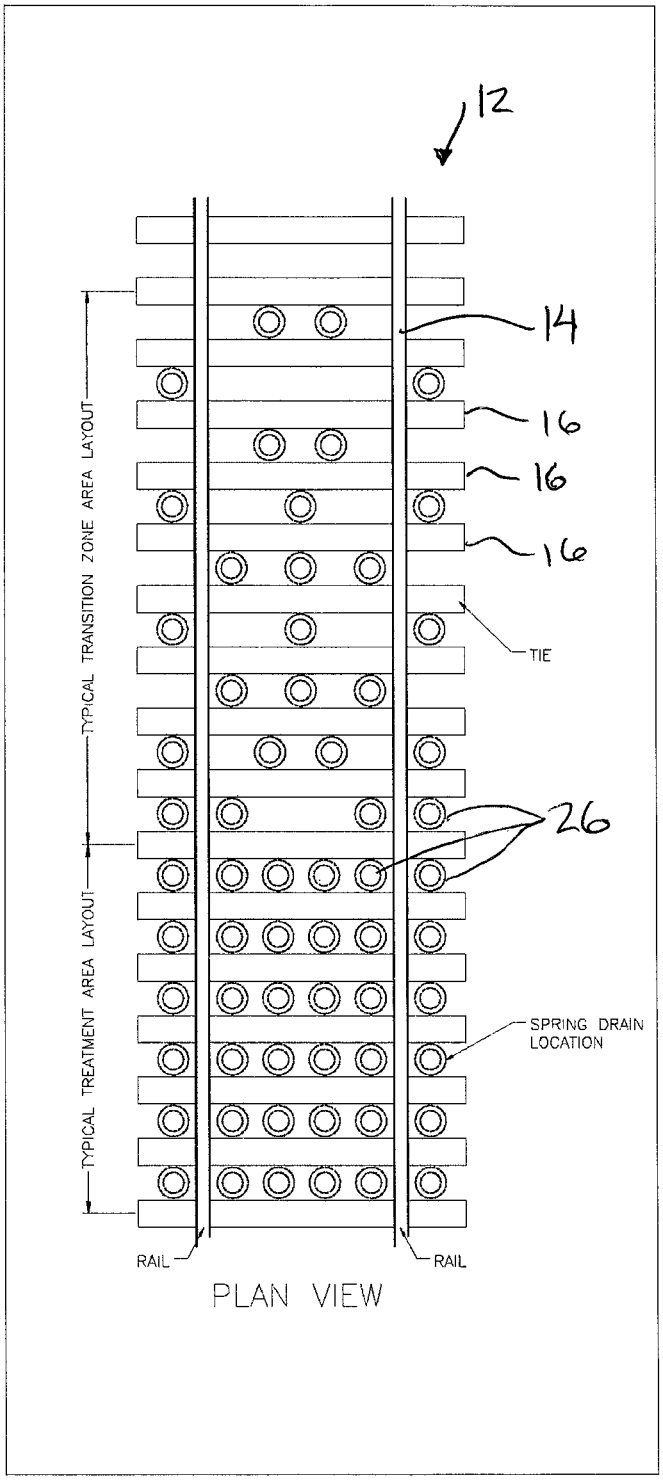
FIG. 2 is a top plan view of a typical layout of drain members according to the ground stabilisation system of FIG. 1.
Figure 3:
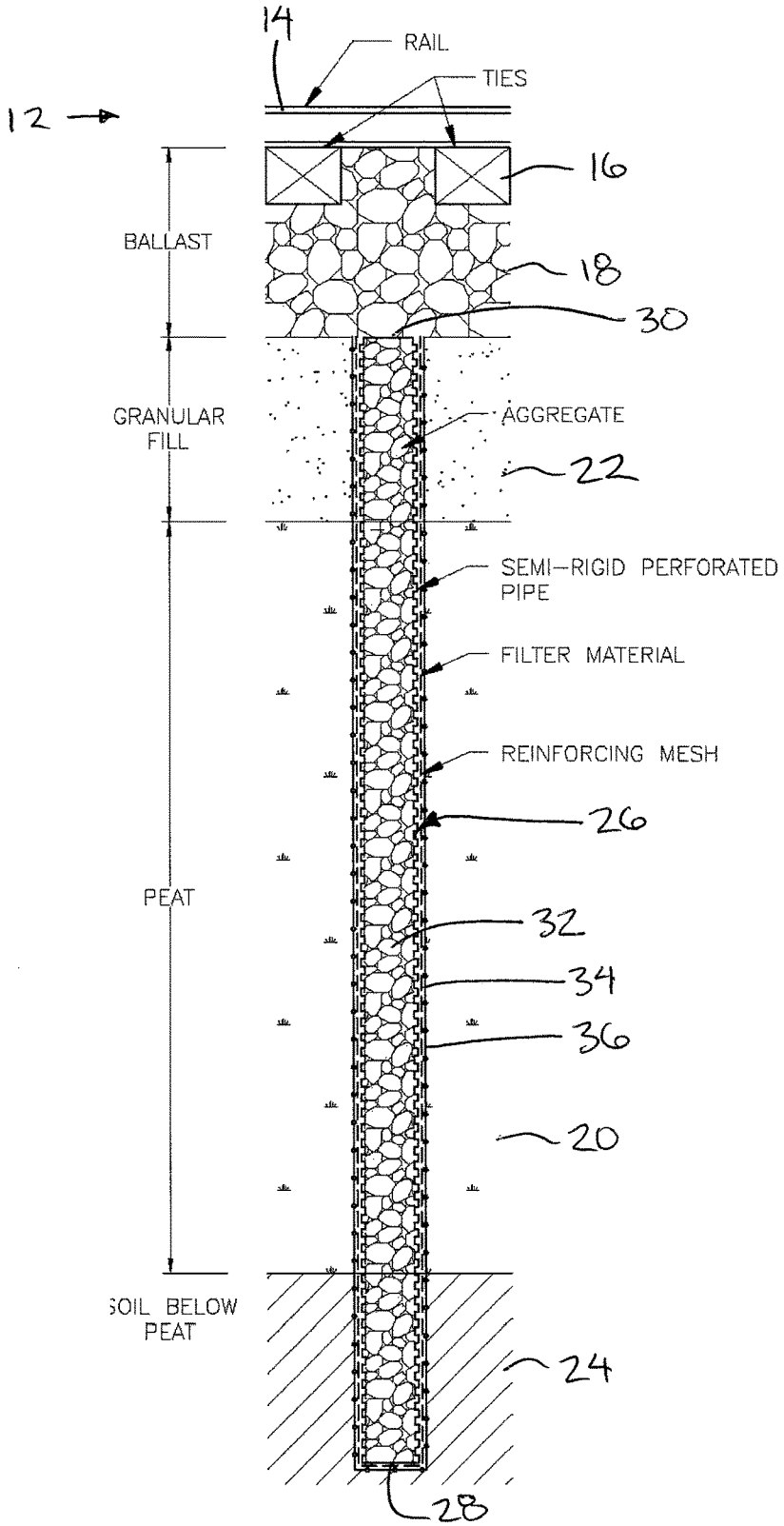
FIG. 3 is a sectional elevational view of one exemplary drain member according to the ground stabilisation system of FIG. 1.
Figure 4:
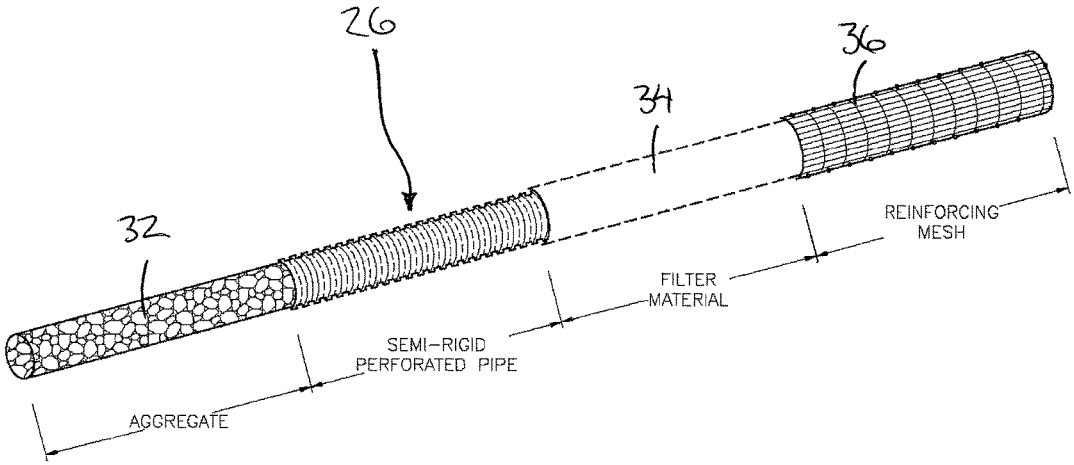
FIG. 4 is a partly sectional perspective view of the exemplary drain member according to FIG. 3.

Each drain member is installed by forming a suitable borehole into the ground, for example using an auger or a water jet and vacuum unit. The drain member is inserted to the appropriate depth as an assembly of the perforated pipe wrapped with the filter material and the reinforcing mesh. The bottom end may be temporarily or permanently closed by a cap or shoe for example for insertion into the ground. Once the drain member has been submerged to span the peat layer, the hollow interior of the drain member is filled through the open top end of the drain member with the aggregate fill 32 having a suitable particle size to impart a desired degree of stiffness to the resulting assembly. The space between the top end of the drain member and the elevation of the rail ties spaced thereabove is then filled with aggregate material similarly sized to the existing aggregate of the ballast layer.

Where there is a primary region which has been identified which requires a stabilization or treatment, each rail tie 16 or each space between an adjacent pair of rail ties within the primary region is provided with a plurality of drain members associated therewith. The drain members are inserted in a row within a respective gap between two rail ties. As best shown in FIG. 2, in the illustrated embodiment six drain members are associated with each rail tie within the primary region to be stabilized.

Additional drain members are also installed within a transition zone extending in the longitudinal direction along the rails away from the primary region in each direction. The ratio of drain members per rail tie is arranged to decrease with increasing distance along the rails from the primary region. As shown in the illustrated embodiment of FIG. 2, the first few rows of drain members nearest to the primary region are provided with four drain members per rail tie, and then three drain members associated with each rail tie respectively. As distance from the primary region increases, the number of drain members per rail tie decreases such that only two drain members are provided within each row associated with each of the subsequent rail ties. This arrangement ensures that there is no sudden drop in stability of the subgrade in the direction of train travel along the rails.

The horizontal spacing between adjacent drain members within each row is selected to be much smaller than the existing drainage path of most of the peat within the peat layer to the nearest permeable boundary of the peat layer. The permeable boundary is understood to be a boundary material adjacent the peat layer that is more permeable than the peat layer.

Figure 5:
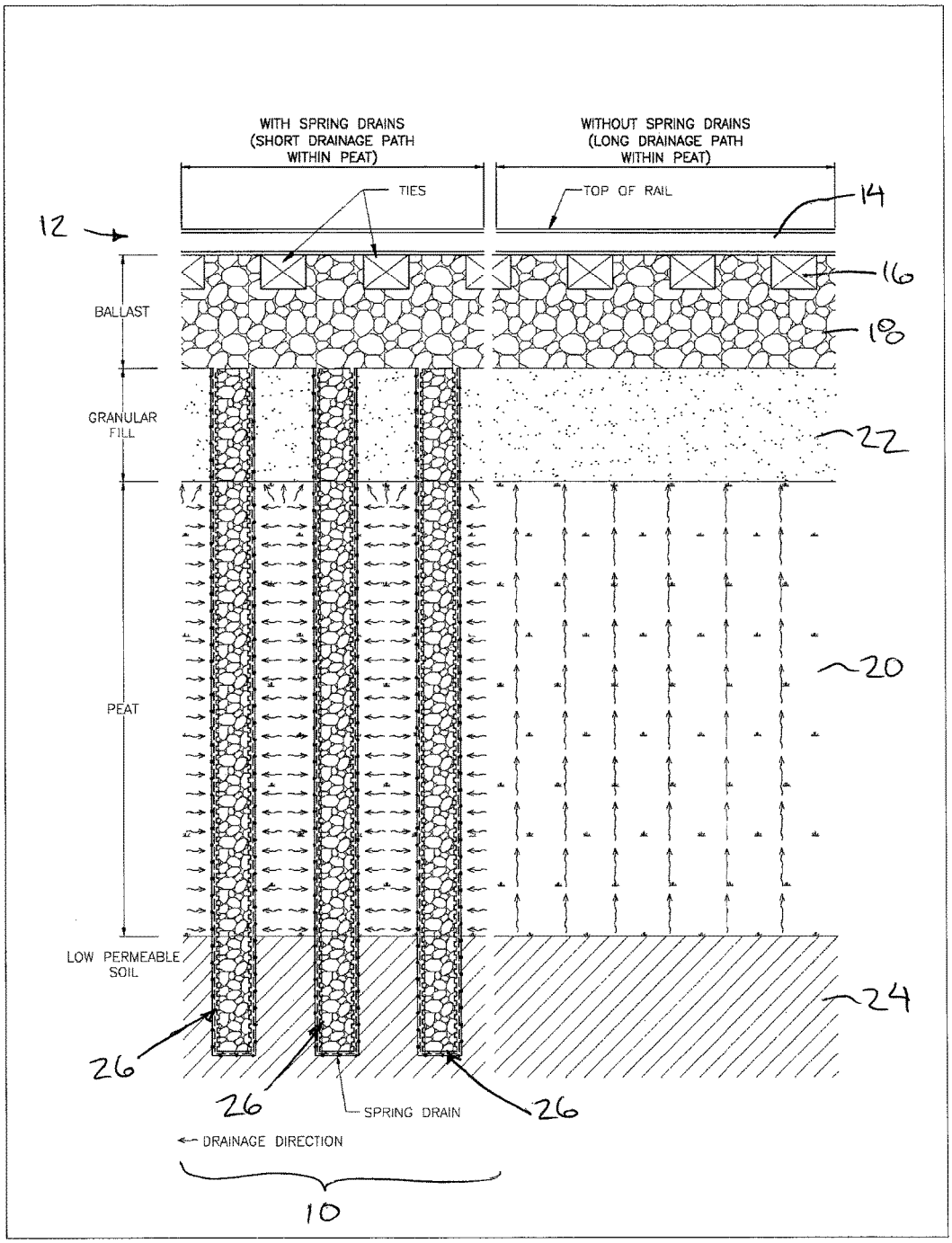
FIG. 5 is a schematic representation of improved peat drainage when low permeable soils are located beneath the lower boundary of the peat layer.

In the illustrated example of FIG. 5, when the soil layer below the peat layer comprises clay which has a lower permeability than the peat layer, the bottom boundary of the peat layer is not considered a permeable boundary such that the drain path of the peat located near to the bottom boundary corresponds to the full height of the peat layer as the peat layer must drain out of the top boundary in this instance. Accordingly the space between adjacent drain members is many times shorter than the longest drain path of the peat which corresponds to the full height of the peat layer.

Figure 6:
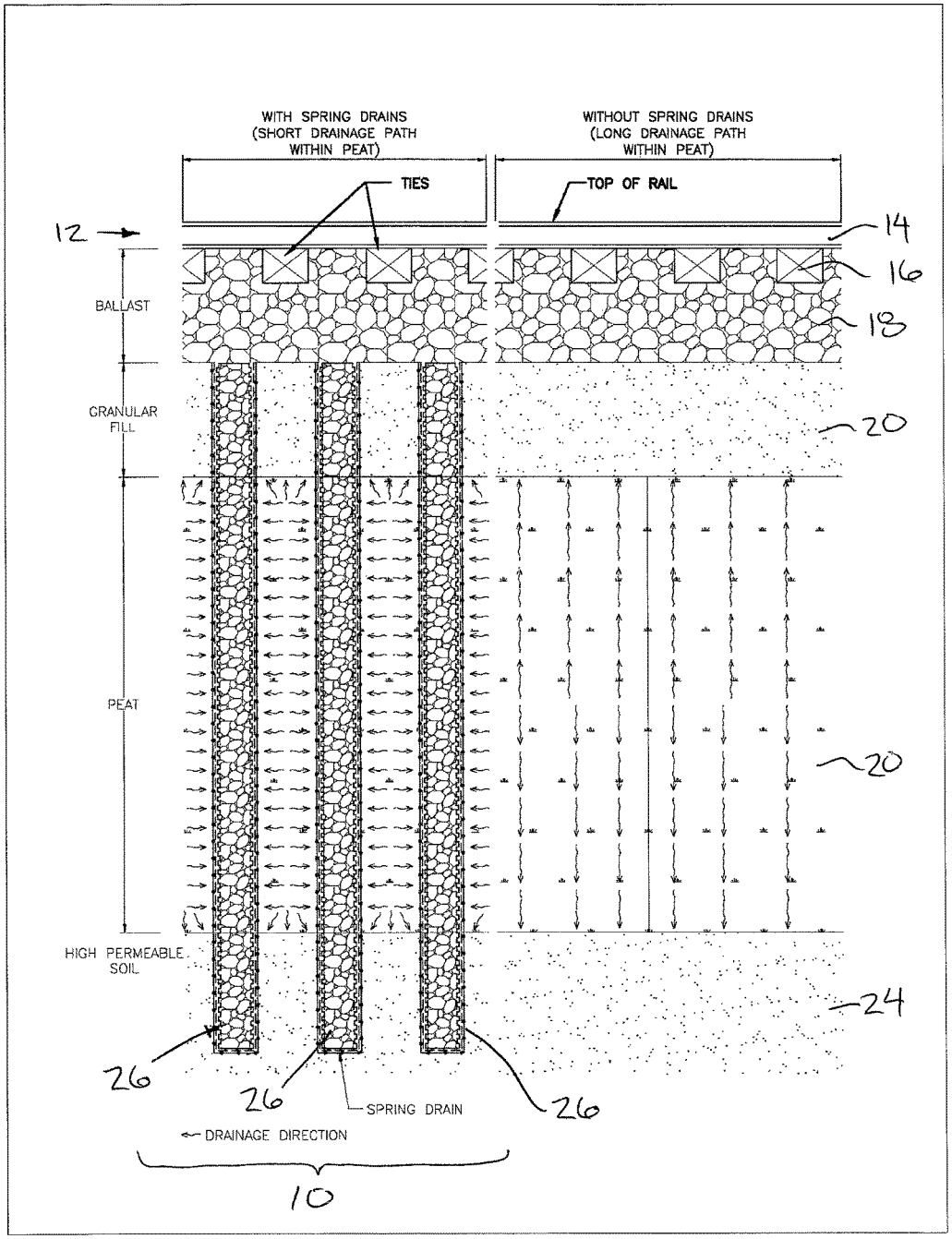
FIG. 6 is a schematic representation of improved peat drainage when high permeable soils are located beneath the lower boundary of the peat layer.
Figure 7:
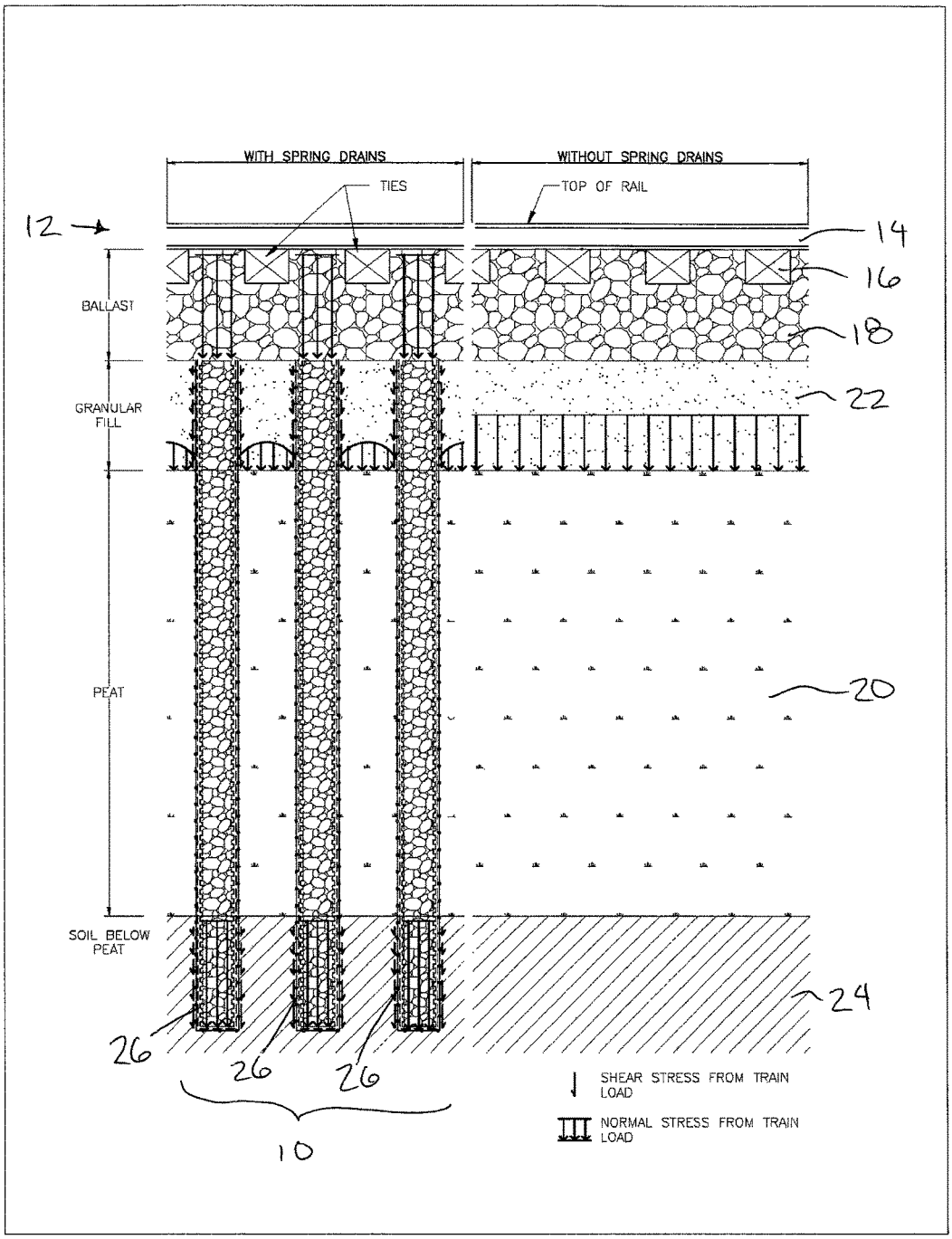
FIG. 7 is a schematic representation of reduced stress on the subgrade peat layer as a result of the drain members according to the ground stabilisation system of FIG. 1.

In the illustrated example of FIG. 6, when the soil layer below the peat layer has a high permeability which is greater than the permeability of the peat layer, the peat layer can drain towards either the top or bottom boundaries of the peat layer such that the longest drainage path of the peat corresponds to only half the height of the peat layer. Even in this instance however the space between adjacent drain members remains many times shorter than the longest drain path of the peat which corresponds to half the height of the peat layer.

As described herein, the system involves the installation of drain members (also referred to herein as spring drains) between the existing ties. These spring drains consist of vertical columnar zones of high permeable materials placed between the ties. The spring drains are installed starting near the base of ballast to allow clearance for periodic ballast replacement. The drains extend through the remaining embankment fills and underlying peat subgrade. The spring drains are terminated within the natural ground below the peat with the depth of termination depending on the type and condition of underlying soil. The spring drains are installed via auger or casing methods. The space above the top of the spring drain is backfilled with ballast.

The spring drains consist of a semi-rigid perforated pipe surrounded by a tensile reinforcing mesh. A filter fabric material may also be used inside the pipe or between the pipe and reinforcing mesh to prevent soil migration into the drain. The pipe is filled with aggregate that is more permeable that the peat soil. The diameter of the drain is less than 0.3 m (to fit between the ties). The spring drain is typically designed to be several times stiffer than the dynamic stiffness of the peat subgrade, but not significantly stiffer than the upper embankment fills and ballast. Use of a fully rigid spring drain (several times stiffer than the embankment fills) is avoided to reduce the risk of upward migration of the spring drain under repeated dynamic loading. The overall stiffness of the spring drain can be varied by the type and placement methods of the aggregate, and the combined stiffness of the perforated pipe and reinforcing mesh.

Improved Drainage: The spring drains provide highly permeable columns within the peat subgrade to accept water flow from within the peat subgrade. The flow of water is generated from the train loading which induces excess porewater pressure with the peat. To be effective, the spring drain is significantly more permeable that the peat. The location and spacing of the spring drains is important. Without the installation of spring drains, the drainage path (defined as the longest path for water to flow through the peat) for the peat layer is typically 0.5 to 1.0 times the thickness of the peat. Where the peat is underlain by less permeable material (such as clay), the drainage path is typically equal to the thickness of the peat. Where the soil below the peat is more permeable (such as sands and gravels), the in-situ drainage path is typically half the peat thickness (as water can escape the peat from the top and bottom of the peat layer). The spring drain spacing must be less than the existing in-situ drainage path to improve drainage characteristics of the peat subgrade. The level of drainage improvement can be adjusted by placing the spring drains closer together. By improving the drainage conditions within the peat subgrade, the excess porewater pressure will dissipate faster between wheel loads and after passage of the train. With faster dissipation, there will also be less build-up of excess porewater pressure, thus reducing the risk of liquefaction and subsequent peat boil activity.

Reduced Loading on Peat Subgrade: As the spring drains are designed to be stiffer than the peat subgrade under dynamic loading, the drains will carry some of the normal stress induced by the train loading that would have been carried directly by the peat. By reducing the normal stress on the peat soil, the magnitude of normal stress induced excess porewater within the peat will be reduced. The overall increase in stiffness of the subgrade can be varied by placing more or less spring drains between the ties (more spring drains=stiffer subgrade). Closer spaced spring drains will carry more load. As the subgrade stiffness will be increased at the treatment area, transition zones, leading up to the treatment area, may be considered to provide a gradual increase in subgrade stiffness.

The spring drains will also improve the shear stiffness of the peat foundation soils. The spring drains will provide additional lateral and shear resistance as the spring drains are significantly stronger and stiffer in shear than the peat they replace. Improving the shear stiffness of the peat subgrade will also reduce shear stress/strain induced excess porewater pressure.

Wave Dissipation: As theorized, a wave of excess porewater pressure likely travels through the peat subgrade in the direction of train travel. As the waves encounter the spring drains (which are stiffer than the peat subgrade), the wave is dissipated and refracted around each spring drain. The spacing of the spring drains (at transition zones to the treatment area) can be arranged to gradually dissipate oncoming porewater pressure waves.

Summary: The use of spring drains is to reduce train induced excess porewater pressures within the peat subgrade which may be caused by any or all of the three modes discussed above. Ideally, the excess porewater pressure would to limited to a level below that required to cause liquefaction of the peat subgrade.

As the spring drains can be installed without significant disruption to train traffic, there is flexibility in design and installation. At first, the treatment can be installed with limited spring drains at wide spacing. The effectiveness of the treatment can be monitoring through the installation of piezometers at select locations within the peat. Should additional reduction in excess porewater pressure be desired, additional spring drains may be installed and the transition zones may be extended. The system can modified by varying the stiffness and drainage properties of the spring drains, the spring drain spacing and transition zone pattern. The treatment is flexible and can target specific areas within swamp crossing and be modified and expanded as required. The system may also be used in conjunction with other techniques such as the use of flanking berms (to further improve stability), or the use of reinforcing mesh (subgrade reinforcement) and/or geotextile (filter) layer above the peat subgrade (peat containment).

Future considerations: Various installation techniques are currently being reviewed to optimize installation in terms of efficiency and performance. These include auger methods, casing and driving methods, wash boring, jetting, vacuum excavation, and modified auger and/or casing heads. Some further considerations are provided in the following:

i) The use of spring drains to reduce excess porewater pressures within soils other than peat is being considered to improve stability and subgrade stiffness.

ii) Several spring drain tips are being considered to address a wide variety of soil/rock types and conditions below the base of peat to improve installation and performance of the system. These include: expanded base treatments, dowels, sacrificial driving tips and/or augers, and rock points.

iii) Installation of inclined or battered drains may also be considered.

iv) Various combinations of semi-rigid perforated piping, filter material, reinforcing mesh and aggregate in-filling are being considered to improve installation efficiency and to vary the stiffness and drainage properties of the spring drain.

v) Various spring drain spacing patterns are being reviewed to optimize the treatment and transition zones.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A ground stabilisation system for a railway having rails supported across rail ties on a ballast layer over a subgrade region which includes a peat layer, the system comprising:

a plurality of pipe assemblies inserted in an upright orientation within the peat layer of the subgrade region, each pipe assembly comprising:

a pipe member formed of semi-rigid material and having a hollow interior;

aggregate fill occupying the hollow interior of the pipe member;

a tensile reinforcing member extending about the pipe member providing tensile reinforcement at least in a circumferential direction about the pipe member; and a plurality of openings in the pipe member which are arranged to allow communication of fluid from the peat layer surrounding the pipe member into the hollow interior of the pipe member so as to be arranged to reduce fluid pressure in the peat layer when the peat layer undergoes dynamic loading from a passing train;

each pipe assembly having a stiffness in an axial direction which is greater than a dynamic stiffness of the peat layer so as to be arranged to reduce loading on the peat layer when the peat layer undergoes dynamic loading from a passing train.

2. The system according to claim 1 wherein a top end of each pipe assembly is spaced below an elevation of the rail ties.

3. The system according to claim 1 further comprising ballast material spanning between a top end of each pipe assembly and an elevation of the rail ties.

4. The system according to claim 1 wherein a top end of each pipe assembly terminates within a fill layer above the peat layer.

5. The system according to claim 1 wherein a bottom end of each pipe assembly terminates within a soil layer below the peat layer.

6. The system according to claim 1 wherein each pipe assembly spans a full height of the peat layer.

7. The system according to claim 1 wherein each pipe member comprises corrugated plastic pipe.

8. The system according to claim 1 wherein the pipe assemblies are more permeable than the peat layer.

9. The system according to claim 1 wherein a horizontal spacing between adjacent pipe assemblies is less than a length of a longest drainage path of peat in the peat layer to a nearest permeable boundary of the peat layer.

10. The system according to claim 1 further comprising a filter material spanning over the openings in each pipe member, the filter material having a smaller aperture size than a size of the openings.

11. The system according to claim 10 wherein the filter material comprises a sheet which fully surrounds each pipe member.

12. A method of stabilising a railway having rails supported across rail ties on a ballast layer over a subgrade region which includes a peat layer, the method comprising:

providing a plurality of elongate pipe members, each including a hollow interior and a plurality of openings therein;

providing a reinforcing member extending about each pipe member so as to provide tensile reinforcement at least in a circumferential direction about the pipe member;

inserting the pipe members in an upright orientation within the peat layer of the subgrade region such that fluid can readily pass through the openings in the pipe members from the peat layer surrounding the pipe member into the hollow interior of the pipe members;

providing aggregate fill occupying the hollow interior of each pipe member such that the pipe member, the reinforcing member and the aggregate collectively define a pipe assembly having a stiffness in an axial direction is greater than a dynamic stiffness of the peat layer so as to be arranged to reduce loading on the peat layer when the peat layer undergoes dynamic loading from a passing train.

13. The method according to claim 12 including horizontally spacing the pipe members relative to one another by a horizontal spacing which is less than a length of a longest drainage path of peat in the peat layer to a nearest permeable boundary of the peat layer.

14. The method according to claim 12 including inserting the pipe members downwardly into the ground through spaces between adjacent ones of the rail ties.

15. The method according to claim 12 including associating a plurality of pipe members with each rail tie in a first region to be stabilized, and gradually reducing the number of drain members associated with each rail tie with increasing distance along the rails from the first region.

16. The method according to claim 12 including forming the pipe assemblies to be more permeable than a permeability of peat in the peat layer.

* * * * *